United States Patent [19]

Jindra

[11] 3,943,978

[45] Mar. 16, 1976

[54] METHOD OF AND APPARATUS FOR LATERAL TENSIONING OF FABRICS

[75] Inventor: Jaromir Jindra, Tyniste nad Orlici, Czechoslovakia

[73] Assignee: Elitex, Zavody textilniho strojirenstui, generalni reditalstui, Liberec, Czechoslovakia

[22] Filed: Aug. 16, 1973

[21] Appl. No.: 388,934

[30] Foreign Application Priority Data

Aug. 16, 1972 Czechoslovakia ..... 5672-72

[52] U.S. Cl. ..... 139/292

[51] Int. Cl.[2] ..... D03J 1/20

[58] Field of Search..... 139/194, 291 C, 302, 303, 139/293, 292; 28/1 C

[56] References Cited

UNITED STATES PATENTS

| | | | |
|---|---|---|---|
| 1,776,230 | 9/1930 | Draper | 139/293 |
| 3,012,587 | 12/1961 | Masolo | 139/293 |
| 3,144,882 | 8/1964 | Steiner | 139/291 |
| 3,174,515 | 3/1965 | Luber | 139/291 C |
| 3,464,920 | 8/1969 | Sakamoto | 139/302 |

*Primary Examiner*—Henry S. Jaudon

[57] ABSTRACT

Method of and apparatus for lateral tensioning or holding of fabrics at a predetermined width. The fabric is formed with at least one auxiliary longitudinal fabric strip joined to the confronting selvedge by uncovered weft threads, the uncovered weft threads being engaged and deflected alternately from above and below in the gap between said strip and the fabric by means of a lever which penetrates between said uncovered weft threads so that, said strip bears against the side of said lever which acts as a temple. Upon further advancement of the fabric the strip is removed from the selvedge thereof.

7 Claims, 3 Drawing Figures

METHOD OF AND APPARATUS FOR LATERAL TENSIONING OF FABRICS

The present invention relates to a method and an apparatus for lateral tensioning or holding of fabrics at a predetermined width.

The temples hitherto used in weaving machines, particularly of the cylindrical type with needled rings have several disadvantages: they deform the weaving plane and may also cause a permanent damaging of the woven goods. Moreover, their construction does not make it possible to tension and hold the fabric immediately at the line of forming said fabric. Last but not least, said temples are expensive to manufacture.

The present invention has among its objects the provision of a new method of laterally tensioning or holding fabrics at a predetermined width, and a simple device for performing said method and apparatus mitigate the disadvantages of the method and devices hitherto known.

In accordance with the invention the fabric is formed with at least one auxiliary longitudinal fabric strip, the uncovered weft threads being engaged and deflected from above and below in the gap between said strip and the fabric by means of a lever which then penetrates between said weft threads, said strip bearing against the side of said lever and being removed upon further advancement of the fabric from the selvedge thereof.

Further advantages and features of the present invention are described in the following specification and shown in the accompanying drawings of a preferred embodiment in form of example.

Figure 1:
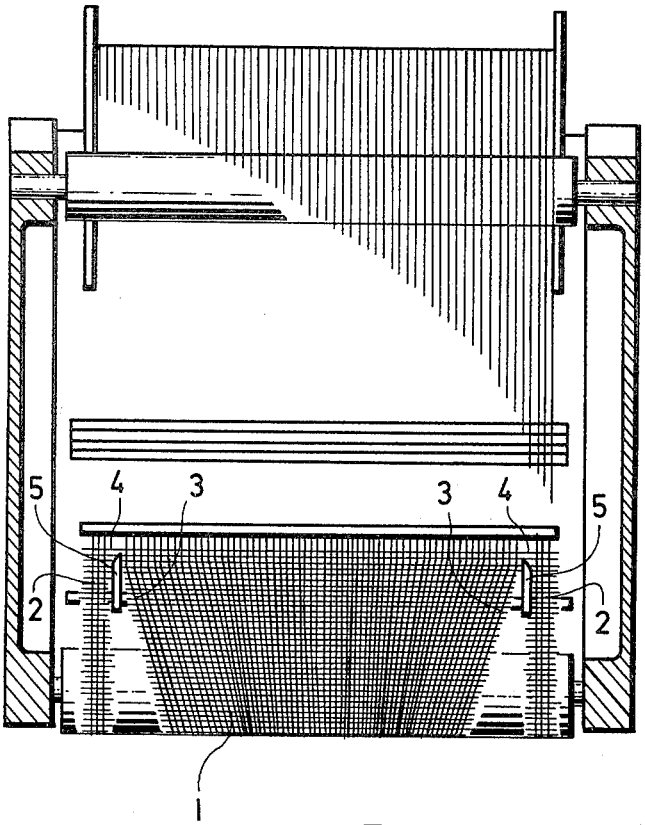
FIG. 1 is a view in plan of the apparatus according to the present invention.
Figure 2:
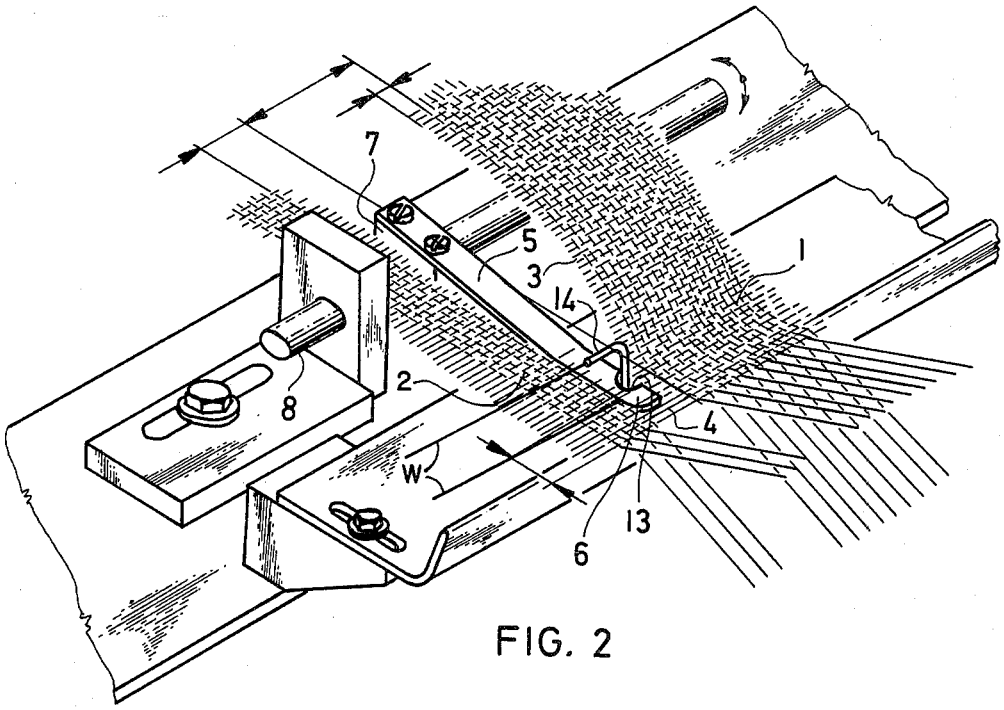
FIG. 2 is a detailed view of the apparatus according to the present invention arranged at the right side of a weaving machine.

The apparatus according to the present invention for the lateral tensioning or holding of fabrics at a predetermined width may be advantageously used at a single side in combination with a conventional tensioning device, or at both sides of a weaving machine (FIG. 1), the said two apparatuses being mutually identical. For simplicity, in FIGS. 2 and 3 there is shown the embodiment of the apparatus according to the present invention arranged on one side of a weaving machine. As shown in FIG. 1, the woven fabric 1 is provided with at least one auxiliary fabric strip 2 at each selvedge 3, the weft threads 4 remaining uncovered between said auxiliary longitudinal strips 2 and said selvedges 3.

Figure 3:
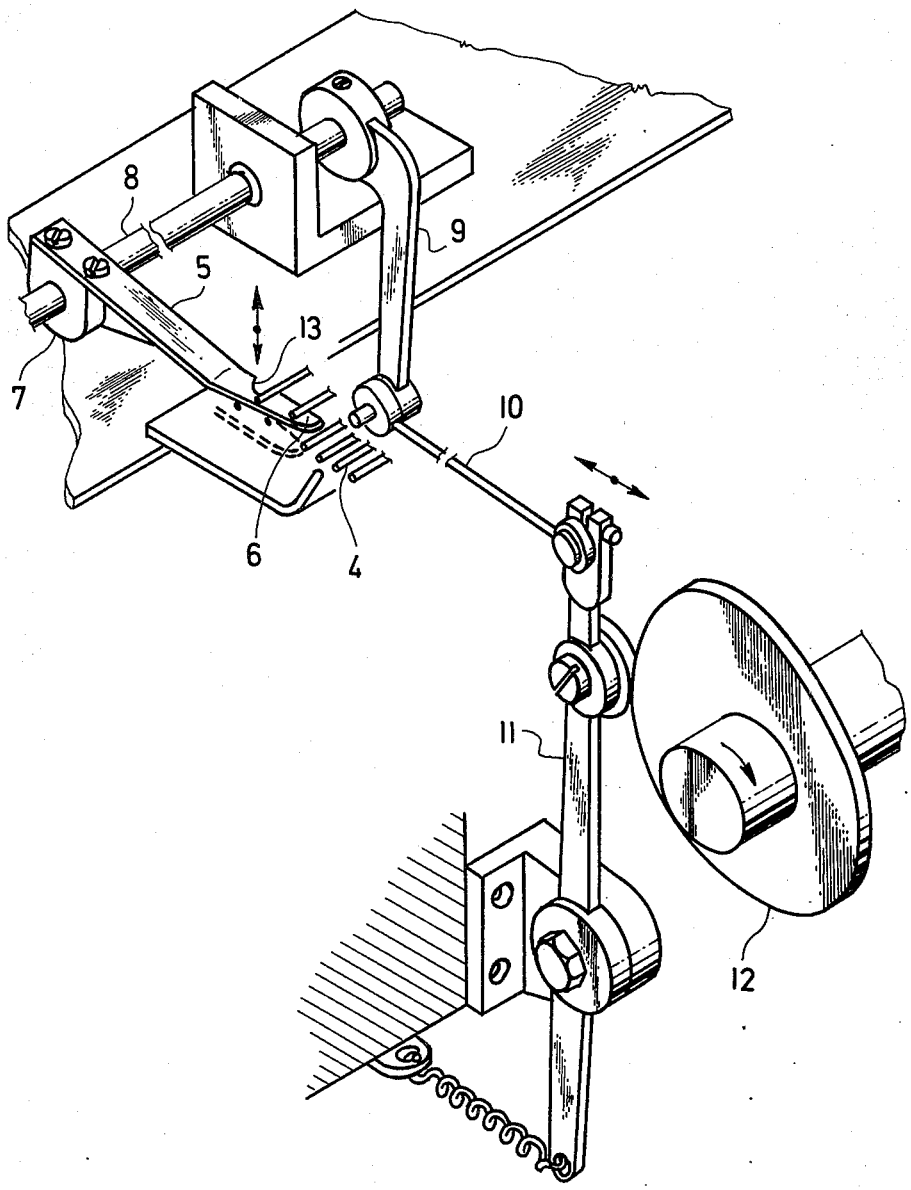
FIG. 3 is an axonometric view of the driving mechanism of the apparatus shown in FIG. 2.

The illustrative embodiment of the apparatus according to the present invention has an oscillating flat lever 5 arranged longitudinally along the selvedge 3 of fabric 1 and an auxiliary longitudinal fabric strip 2. The lever 5 oscillates between an upper position shown with full lines and a lower position, shown with dotted lines, (FIG. 3). The free end 6 of the flat lever 5 is situated immediately in front of the fabric fell and is suitably machined, e.g. pointed, in order to be able to deflect upwardly and then downwardly the uncovered weft 4 so as to penetrate between said weft threads without damage. As the fabric 1 is advanced by the fabric take up means, the uncovered weft 4, in an alternating manner, moves over the top surface or beneath the bottom surface of flat lever 5. Simultaneously the auxiliary fabric strip 2 is drawn into contact with the outwardly directed side portion of lever 5. The flat lever 5 is fastened by means of a hub 7 on a shaft 8 which is common to the two identical apparatuses disposed on opposite sides of the weaving machine. The levers 5, acting against the fabric strips 2, maintain the fabric at a selected predetermined width and under lateral tension. Shaft 8 is attached to a control cam 12 by means of a lever 9, a tie rod 10, and a two-arm lever 11, said control cam oscillating said shaft 8. Cam 12 is driven continuously in one direction e.g. from the main shaft of the weaving machine. The flat lever 5 is provided at an appropriate distance from its free end 6 with a recess 13 through which there passes a mechanism 14 for separating weft threads 4. In the illustrative embodiment said mechanism is constituted e.g. by a known hot wire or burning loop mounted on shaft 8 and oscillating therewith. The hot wire is supplied with electric current through Wires. Other cutting devices, not shown, likewise mounted on shaft 8 and oscillating therewith may be employed if desired.

Recess 13 for permitting the passage of mechanism 14 for separating or cutting the weft threads is located on flat lever 5 at its side nearer to fabric 1 so that the ends of the burned or cut weft threads 4 projecting from fabric selvedges 3 should be as short as possible.

The above-described apparatus operates as follows:

During the forming of fabric 1 and the auxiliary longitudinal fabric strips 2 which are reinforced e.g. by leno weave, the free end 6 of the flat lever 5 during a beat-up of weft 4 swings reversely about the plane of the weft system to alternately engages and deflects the uncovered weft threads 4 from above and below. Simultaneously, as the fabric 1 is advanced, the tip 6 of lever 5 penetrates between the uncovered weft threads 4 so as to cause said lever to lie first above and then beneath pre-determined members of said weft 4 and to thereby bring auxiliary strip 2 into engagement with the edge of said lever 5.

The fabric 1 along with integrally formed auxiliary strips 2 is advanced over shaft 8 toward the cloth roll of the weaving machine. Fixed at predetermined longitudinal positions on shaft 8 are levers 5 which, as the fabric advances move between over and under the uncovered weft portions 4. This interweaving of ends 6 of shafts 5 with weft threads 4 causes the auxiliary strips 2 to be brought into contact with the outwardly facing edges of the lever 5. The interaction between said levers and said strips along with the fixed lateral positions of levers 5 maintain fabric 1 in a tensioned condition in the weaving area. Upon further advancement of the fabric 1 and the auxiliary strip 2, the separate uncovered weft threads 4 are successively burned or cut off by mechanism 14 with which they come into contact. Following such burning or cutting of the uncovered weft threads 4, the fabric 1 shrinks into its untensioned state.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A method of laterally tensioning a fabric at a predetermined width during the weaving of the fabric, comprising forming the fabric with at least one auxiliary longitudinal fabric strip connected with the fabric by uncovered weft threads, alternately engaging and deflecting the uncovered weft threads from above and below by means of a lever so that as the fabric advances the lever penetrates between said deflected weft threads so as to cause the strip to be supported against the side of the lever, and separating the strip from the fabric selvedge upon further advancement of the fabric.

2. Apparatus for laterally tensioning a fabric at a predetermined width during the advancement of a fabric as it is woven on a weaving machine employing an advancing warp and means for inserting weft in a stepwise manner, comprising means for forming the fabric with at least one auxiliary longitudinal fabric strip along a selvedge and spaced from the selvedge by uncovered warp threads, means for penetrating between the uncovered weft threads by alternately engaging and deflecting said weft threads from above and below as the fabric is advanced, and means for separating the auxiliary strip from the fabric selvedge upon further advancement of the fabric.

3. Apparatus as claimed in claim 2, wherein the means for alternately engaging and deflecting the uncovered weft threads from above and below comprises a lever with a free end, being directed towards the point of forming the fabric, and means for oscillating the free end of the lever about the plane of the weft system.

4. Apparatus as claimed in claim 3, wherein the mechanism for separating the deflectied uncovered weft threads from the fabric is disposed near the side of the lever.

5. Apparatus as claimed in claim 4, wherein the lever is flat, one side of the flat lever confronts the uncovered weft threads and the edge of the lever near the selvedge is provided with a recess through which the means for separating the uncovered weft threads passes.

6. Apparatus as claimed in claim 3, wherein the free end of the lever is pointed.

7. Apparatus as claimed in claim 5, wherein the means for separating the uncovered weft threads is a mechanism for burning such weft threads.

* * * * *